US010246305B2

(12) United States Patent
Bläsi

(10) Patent No.: US 10,246,305 B2
(45) Date of Patent: Apr. 2, 2019

(54) ELEVATOR HAVING A MOVABLE MACHINE ROOM

(71) Applicant: Inventio AG, Hergiswil (CH)

(72) Inventor: Pascal Bläsi, Dierikon (CH)

(73) Assignee: INVENTIO AG, Hergiswil NW (CH)

( * ) Notice: Subject to any disclaimer, the term of this patent is extended or adjusted under 35 U.S.C. 154(b) by 0 days.

(21) Appl. No.: 15/535,748

(22) PCT Filed: Dec. 14, 2015

(86) PCT No.: PCT/EP2015/079548
§ 371 (c)(1),
(2) Date: Jun. 14, 2017

(87) PCT Pub. No.: WO2016/096694
PCT Pub. Date: Jun. 23, 2016

(65) Prior Publication Data

US 2017/0327348 A1 Nov. 16, 2017

(30) Foreign Application Priority Data

Dec. 16, 2014 (EP) ..... 14198086

(51) Int. Cl.
*B66B 19/00* (2006.01)
*B66B 9/00* (2006.01)
*B66B 11/00* (2006.01)

(52) U.S. Cl.
CPC ..... *B66B 19/005* (2013.01); *B66B 9/00* (2013.01); *B66B 11/0045* (2013.01)

(58) Field of Classification Search
CPC ..... B66B 19/005; B66B 9/00; B66B 11/0045
See application file for complete search history.

(56) References Cited

U.S. PATENT DOCUMENTS 3,519,101 A * 7/1970 Sieffert ..... B66B 9/187 187/256
5,553,686 A * 9/1996 Jensen ..... B66B 7/02 187/408
9,809,424 B2 * 11/2017 Peacock ..... B66B 19/00
2005/0150728 A1 * 7/2005 Van Der Meijden ..... B66B 19/002 187/411

(Continued)

FOREIGN PATENT DOCUMENTS

CN 102666347 A 9/2012
CN 103402901 A 11/2013

(Continued)

*Primary Examiner* — Michael A Riegelman
(74) *Attorney, Agent, or Firm* — William J. Clemens; Shumaker, Loop & Kendrick, LLP

(57) ABSTRACT

An elevator system includes an elevator shaft, an elevator car arranged in the elevator shaft for movement, a drive unit for moving the elevator car, a machine platform that can be fastened in the elevator shaft and can be lifted along the elevator shaft, wherein the drive unit is fastened to the machine platform, and at least one lifting device for lifting the machine platform. The at least one lifting device includes a supporting element, a strand jack for moving along the supporting element, and an anchor for fastening the supporting element in the elevator shaft, wherein the supporting element is fastened in the elevator shaft by the anchor and the strand jack is arranged to move along the supporting element.

9 Claims, 3 Drawing Sheets

(56) References Cited

U.S. PATENT DOCUMENTS

| | | | | |
|---|---|---|---|---|
| 2007/0170014 | A1* | 7/2007 | Woronoff | B66B 5/16 187/414 |
| 2010/0133048 | A1* | 6/2010 | Barneman | B66B 19/00 187/414 |
| 2011/0113720 | A1* | 5/2011 | Peacock | B66B 19/00 52/741.1 |
| 2012/0291395 | A1* | 11/2012 | Plathin | B66B 19/00 52/741.1 |
| 2014/0000987 | A1* | 1/2014 | Peacock | B66B 19/00 187/414 |
| 2014/0013562 | A1* | 1/2014 | Nakamura | B66B 19/007 29/402.01 |
| 2014/0264215 | A1* | 9/2014 | Yustus | E04H 12/344 254/93 R |
| 2015/0336771 | A1* | 11/2015 | Yoshikawa | B66B 19/007 52/741.1 |
| 2016/0152442 | A1* | 6/2016 | Weber | B66B 19/00 187/359 |
| 2017/0166419 | A1* | 6/2017 | Rasanen | B66B 19/005 |
| 2017/0327348 | A1* | 11/2017 | Blasi | B66B 19/005 |

FOREIGN PATENT DOCUMENTS

| | | | |
|---|---|---|---|
| CN | 104024141 | B | 9/2014 |
| EP | 1918240 | A1 | 5/2008 |
| JP | H03264482 | A | 11/1991 |
| WO | 2005084185 | A2 | 9/2005 |
| WO | 2010100319 | A1 | 9/2010 |
| WO | 2011080387 | A1 | 7/2011 |
| WO | 2011148033 | A1 | 12/2011 |

* cited by examiner

ELEVATOR HAVING A MOVABLE MACHINE ROOM

FIELD

The invention relates to an elevator system with a drive unit which is fixed to a machine platform which is movable along an elevator shaft.

BACKGROUND

The elevator system is usually integrated in a building. For this purpose the building comprises a shaft which extends over several floors of the building. The elevator system comprises at least one elevator car. The elevator car is moved by means of a drive unit along substantially vertical guide rails in the elevator shaft. In tall buildings lower regions of the building are already fitted with a functional elevator system whilst upper regions of the building are still under construction. In this case, special so-called co-growing elevator systems are used. This means that during the construction period of the building, a machine room of the elevator system is moved from a lower temporary usage position in the elevator shaft to a next upper usage position in the elevator shaft. The machine room is accordingly configured as a movable machine platform. In this case, it is important inter alia that this machine platform is balanced out during its displacement in the elevator shaft.

The movable machine platform can also be used to receive or to transport other elevator components. Usually at least one end roof is located above the machine platform at the end of the respective building section. Above the end roof, the building can be constructed further whilst the elevator car is already operating below the machine platform, i.e. can be moved.

As soon as a next-higher travel region of the elevator shaft is completed, the necessary elevator components such as for example the guide rails can be installed above the machine platform in the elevator shaft. When the next-higher travel region is ready, the machine platform can be moved so that this next-higher travel region or a corresponding part of the building can be made accessible to the elevator car. Since the building is constructed from bottom to top, the machine platform is usually moved from a lower temporary usage position to an upper optionally temporary usage position.

Such a movable machine platform is usually supported or anchored by means of settling devices such as supports or rests on a side wall of the elevator shaft or in recesses in the wall of the shaft.

Usually the machine platform can be lifted by means of a chain hoist in the elevator shaft. Such a heavy chain hoist is located above the machine platform. Consequently a disadvantage is that the installation of the chain hoist above the machine platform requires a great effort. In addition the installation of the guide rails which is continued directly above the machine platform by a working platform is made difficult since the chain of the chain hoist is arranged approximately centrally within the horizontal elevator shaft cross-section along the elevator shaft. Furthermore, for the furthest possible raising of the machine platform by the winding up of the chain, a minimum distance is required between the machine platform and the installation site of the chain hoist.

SUMMARY

Accordingly, it is an object of the invention to provide an elevator system which enables a simplified and space-saving installation of the components of the elevator system.

The object is solved by an elevator system comprising an elevator shaft, an elevator car which is arranged movably in the elevator shaft, a drive unit for moving the elevator car, a machine platform which can be fixed in the elevator shaft and lifted along the elevator shaft, wherein the drive unit is fixed on the machine platform and has at least one lifting device for lifting the machine platform, wherein each of the at least one lifting device comprises a supporting element, a strand jack for moving along the supporting element and an anchor for fixing the supporting element in the elevator shaft, wherein the supporting element is fixed in the elevator shaft by means of the anchor and the strand jack is arranged in such a manner that the strand jack is movable along the supporting element.

Such a known strand jack comprises two clamping devices, wherein a first of these clamping devices can be fixed in the elevator shaft or to the machine platform. The second of these clamping devices is arranged displaceably in the direction of the longitudinal extension of the supporting element in such a manner that a distance of the second clamping device to the first clamping device is variable.

The first clamping device clamps the supporting element of the lifting device in the elevator shaft. Accordingly the first clamping device, i.e. the lifting device itself, is fixed on the supporting element. Consequently the machine platform in the elevator shaft is optionally suspended or fixed independently of a supporting device for supporting the machine platform in the elevator shaft.

The raising of the machine platform can be effected by a movement of the supporting element along the elevator shaft and thus of the machine platform fixed on the supporting element or by a movement of the machine platform along the supporting element fixed in the elevator shaft. For raising the machine platform the second clamping device should be arranged on the supporting element or displaced along the supporting element in such a manner that as a result of a fixing of the second clamping device on the supporting element and subsequent displacement of the second clamping device with respect to the first clamping device, the machine platform can be raised in the elevator shaft. Subsequently the second clamping device should be fixed on the supporting element. Before the machine platform can be raised in the elevator shaft by means of the displacement of the second clamping device with respect to the first clamping device, the second clamping device should accordingly be fixed on the supporting element and then the first clamping device released from the supporting element.

After a lifting movement accomplished in such a manner, the first clamping device can be fixed on the supporting element and then the second clamping device can be released from the supporting element. Furthermore, additional lifting movement can be executed according to the described sequence. In a corresponding manner the machine platform can also be lowered in the elevator shaft.

The said movement of the strand jack along the supporting element should be understood as a relative movement of the strand jack with respect to the supporting element. Accordingly, for example, the supporting element or the strand jack can be arranged in a stationary manner in the elevator shaft. That is, for example, that the lifting movement resulting from the operation of the lifting device can be achieved by a movement of the supporting element by means of the strand jack arranged in a stationary manner in the elevator shaft. Alternatively to this, the lifting movement resulting from the operation of the lifting device can be achieved by a movement of the strand jack along the supporting element arranged in a stationary manner in the elevator shaft.

The invention is based on the finding that the supporting element is arranged largely above the machine platform in that part of the elevator shaft in which part the installation of the elevator system is continued. That is that the machine platform is suspended in the elevator shaft by means of the lifting device. A first of the components to be fixed in the elevator shaft comprising the strand jack and the anchor can be fixed on the machine platform. The second of the components of the lifting device to be fixed in the elevator shaft comprising the strand jack and the anchor would accordingly be fixed in the elevator shaft above the machine platform. Accordingly the strand jack can be fixed on the machine platform and the anchor above the machine platform in the elevator shaft or vice versa. Consequently, the installation of guide rails and other elevator components above the machine platform is difficult by conventional means for lifting the machine platform. Accordingly, an attempt was made to simplify the continuing installation of the elevator system by configuring the means.

The designation 'strand jack' should not be understood as restrictive within the scope of this description to the effect that the supporting element of the lifting device must be configured as a strand. Such a supporting element of the lifting device can be configured as wire cable, that is a twisting of individual strands or as a strand, that is a twisting of individual wires, or as another supporting element which can be moved by means of the strand jack.

A further development of the elevator system comprises a second lifting device for lifting the machine platform. By means of this second lifting device it is possible to place both lifting devices largely freely. That is that the position both of the one and of the other lifting device in the horizontal can be specified in such a manner that work above the machine platform is not adversely affected as far as possible by the at least one lifting device.

As a result of the lifting of the machine platform, the loaded part of the supporting element is shortened since the distance between the machine platform on which the supporting element is fixed on the one hand and the component of the elevator system on which the supporting element is fixed on the other hand is reduced. Accordingly, during lifting of the machine platform a section of the supporting element substantially unloaded by tensile stressing is lengthened. A tensile stressing of the section of the supporting element unloaded in such a manner can accordingly result only as a result of the own weight of the supporting element. The supporting element itself is configured to be comparatively strong as a result of the high mass of the machine platform to be lifted on which the mass of the elevator car is possibly also suspended during the period of its lifting.

In a further development of the elevator system, the strand jack is fixed on the machine platform. When the strand jack is fixed on the machine platform, the supporting element of the lifting device is accordingly left substantially in its position in the elevator shaft since the machine platform climbs up this suspended supporting element. It is advantageous that above the anchor for fixing the supporting element in the elevator shaft, no space requirement is necessary for a mounting of the said substantially unloaded section of the supporting element. This unloaded section of the supporting element can for example, be arranged as far as possible next to the elevator car located in its uppermost position.

Furthermore, the strand jack fixed on the machine platform can be fixed in such a manner on the machine platform that the section of the supporting element arranged directly underneath the strand jack is arranged outside a vertical projection of the elevator car or the machine platform can have a deflector for guiding the supporting element, wherein the deflector is configured in such a manner that the section of the supporting element arranged underneath the machine platform in the elevator shaft is located outside the travel path of the elevator car. Such a deflector enables the placement of the at least one lifting device to be made independently of the components of the elevator system arranged underneath the machine platform which have already been put into operation. The arrangement of the strand jack in such a manner that the section of the supporting element substantially unloaded by tensile stress which is arranged directly underneath the strand jack is arranged outside a vertical projection of the elevator car, i.e. not vertically above the elevator car, constitutes another possibility of mounting the substantially unloaded section of the supporting element in an uncomplicated manner without the functionality of the elevator system being restricted.

Furthermore, the elevator system can comprise a counterweight. A deflector of the machine platform can also be configured so that the supporting element of the lifting device does not collide with the counterweight. The strand jack fixed on the machine platform can be fixed on the machine platform in the presence of such a counterweight in such a manner that the section of the supporting element preferably substantially unloaded by tensile stress which is arranged directly underneath the strand jack is arranged outside a vertical projection of the counterweight.

Alternatively to this, the anchor of the lifting device can be fixed on the machine platform. When the anchor is fixed on the machine platform, the supporting element of the lifting device is accordingly moved in the upper part of the elevator shaft. It is advantageous in this case that the unloaded part of the supporting element does not project into the region of the elevator system which has already been put into operation, i.e. arranged underneath the machine platform. The unloaded section of the supporting element would accordingly be arranged above the strand jack fixed in the elevator shaft if a sufficiently high section of the elevator shaft is available for this.

A further development of the elevator system comprises a lifting platform which can be fixed in the elevator shaft for lifting the machine platform, wherein the lifting platform is arranged in the elevator shaft above the machine platform, wherein the second of the components of the lifting device to be fixed in the elevator shaft comprising the strand jack and the anchor is fixed on the lifting platform. Accordingly the anchor of the lifting device is fixed on the lifting platform if the strand jack is fixed on the machine platform and vice versa. Such a lifting platform on which the said component of the lifting device is fixed makes it possible that the possibly temporary shaft ceiling of the elevator shaft need only have a relatively low load-bearing capacity. Accordingly, the entire machine platform and the drive unit fixed on the machine platform and the elevator car cannot be suspended on this possibly temporary shaft ceiling. For this purpose the machine platform or the drive unit or the elevator can be raised on the anchorable lifting platform. The lifting platform itself can be suspended and lifted for example on the temporary shaft ceiling when the machine platform is fixed in the elevator shaft.

In a further development of the elevator system, the lifting platform is fixed by means of at least one supporting element on a side wall of the elevator shaft, wherein the supporting element, which supporting element is fixed to the lifting platform by means of the strand jack fixed on the lifting platform or the anchor fixed on the lifting platform, is spaced apart from the fixing point of the supporting element on the side wall by a maximum horizontal distance of 700 mm, preferably 500 mm. It is advantageous that the lifting platform must be configured less stably since the lever effect of the load suspended on the lifting platform is lower.

In a further development of the elevator system, the strand jack of the at least one lifting device is based on the hydraulic functional principle. That is that a liquid, such as for example oil, can be used in order to enable the said displacement of the second clamping device with respect to the first clamping device. It is advantageous when using a liquid that the liquid itself is not very compressed during the transmission of high forces and accordingly a simple controllability can be achieved. The hydraulics of such a lifting device can be connected in a simple manner for example by means of a control device.

A further development of the elevator system comprises two guide rails fixed in the elevator shaft, wherein the guide rails are suitable for guiding the elevator car and for guiding the machine platform, wherein the drive unit is fixed to the machine platform in such a manner that the center of gravity of the drive unit acting on the machine platform is spaced apart from a rail axis, which rail axis is a shortest possible rectilinear connection between the two guide rails and the strand jack(s) or the anchor(s) of the at least one lifting device are spaced apart from the rail axis on the machine platform in such a manner that the machine platform is substantially balanced out. Accordingly the positioning of the strand jack(s) or the anchor(s) can be varied as required. As a result of such an attainable balancing out of the machine platform, it is possible that the guide tracks of the guide rails need receive substantially no substantial transverse forces. That is, the guide rails must now be designed merely to ensure guidance of the elevator car. This results in the advantage that the said guide rails need to be configured to be less stable and therefore a simplification of the installation of the elevator system can be achieved.

In a further development of the elevator system, the supporting element of the at least one lifting device has a substantially circular cross-section having a diameter between 10 mm and 30 mm, preferably between 15 mm and 20 mm. The supporting element of the at least one lifting device can be configured as wire cable. In such a manner, possibilities for ensuring the required load-bearing capacity of the supporting element are provided. In connection with the strand jack fixed on the machine platform, there is the advantage that the mounting of the section of the supporting element largely unloaded by tensile stressing to be performed in the elevator shaft has no additional space requirement.

DESCRIPTION OF THE DRAWINGS

The invention is explained in detail hereinafter with reference to the figures. In the figures.

DETAILED DESCRIPTION

Figure 1:
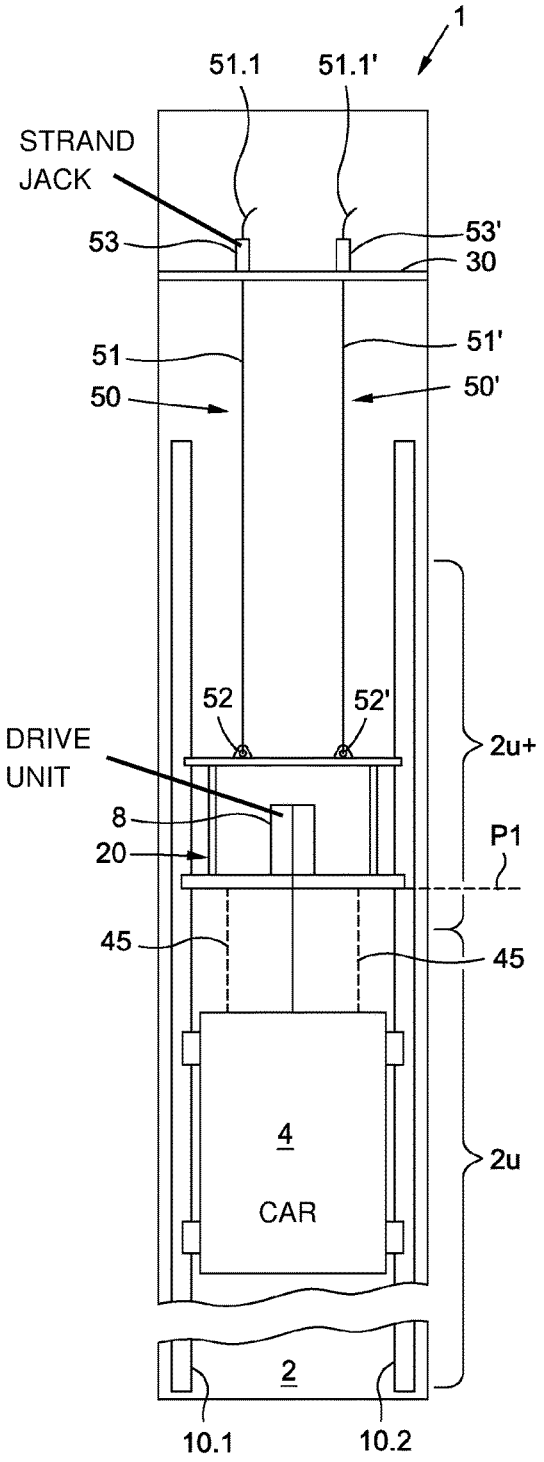
FIG. 1: shows an elevator system according to a first embodiment with a movable machine platform in a lower temporary usage position.
Figure 2:
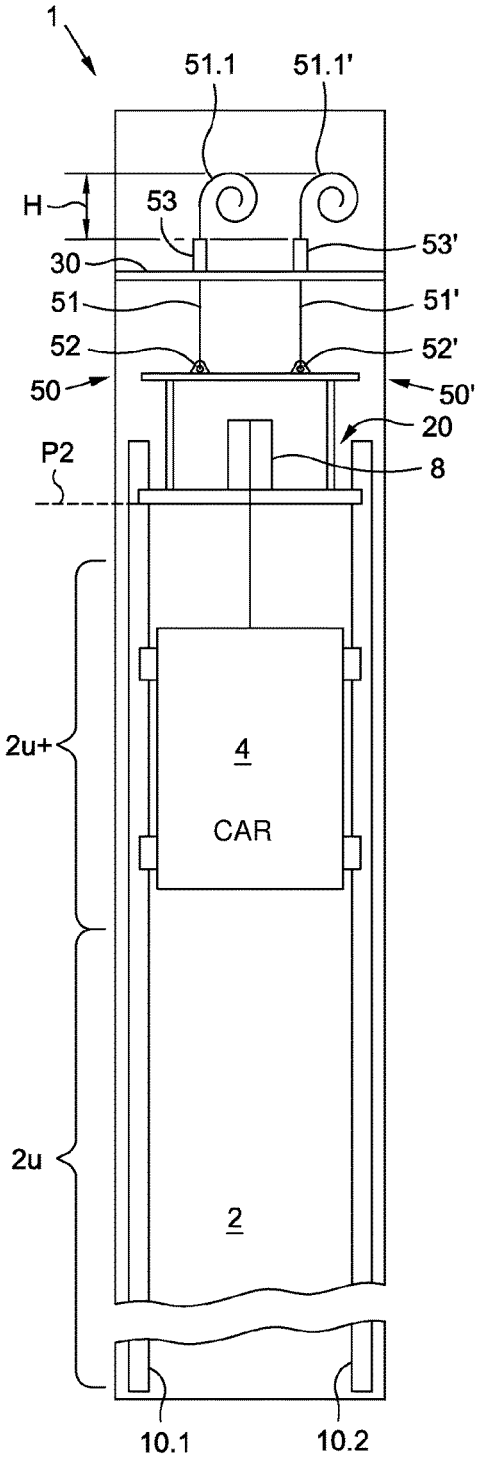
FIG. 2: shows the elevator system from FIG. 1 after raising the movable machine platform to an upper usage position.

FIGS. 1 and 2 show an elevator system 1 installed in a building. The elevator system 1 comprises an elevator shaft 2, an elevator car 4 disposed in the elevator shaft 2, a machine platform 20 and at least one lifting device 50, 50' for lifting the machine platform 20. A drive unit 8 for moving the elevator car 4 is fixed on the machine platform 20. The elevator car 4 is preferably movable along guide rails 10.1, 10.2 in the elevator shaft 2. Further elevator components required for operation of the elevator system 1 can be fixed to the machine platform 20. For example, the machine platform 20 can be fixed to the side walls of the elevator shaft 2 by means of a settling device not shown. Preferably this settling device is formed from extendable rests and/or supports.

The lifting device 50, 50' comprises a lifting supporting element 51, 51', a strand jack 53, 53' and an anchor 52, 52' for fixing the supporting element 51, 51' in the elevator shaft 2. The anchor 52, 52' shown according to FIGS. 1 and 2 and accordingly also the supporting element 51 of the lifting device 50 are fixed to the machine platform 20. The strand jack 53, 53' of the lifting device 50, 50' is fixed above the machine platform 20 in the elevator shaft. Between the anchor 52, 52' and the strand jack 53, 53' of the at least one lifting device 50, 50', the supporting element 51, 51' of this lifting device 50, 50' can be loaded by tensile stressing since the machine platform 20 can be suspended in the elevator shaft 2 by means of this section of the supporting element 51, 51'. A section 51.1, 51.1' of the supporting element 51, 51' substantially unloaded by tensile stressing is located above the strand jack 53, 53'.

A lifting platform 30 can be arranged above the machine platform 2, on which lifting platform 30 the strand jack 53, 53' can be fixed. This lifting platform 30 can be lifted, for example, inside the elevator shaft 2 when the machine platform 20 itself is fixed, i.e. fixed, in the elevator shaft 2. Underneath the machine platform 20 the elevator car 4 can be moved in a lower region 2*u* of the elevator shaft 2. Thus, the elevator car 4 which can be moved in the lower region 2*u* can be used for transporting elevator passengers.

FIG. 1 shows the machine platform 20 arranged in a lower temporary usage position P1, wherein the region 2*u*+ of the elevator shaft 2 arranged substantially above this lower temporary usage position P1 is already completed. This can be seen for example by means of the fixed and aligned guide rails 10.1, 10.2 arranged in this region 2*u*+.

By means of the at least one lifting device 50, 50' which is suspended at an anchor of the machine platform 20 configured as suspension point 52, 52', the machine platform 20 or the entire machine chamber can be raised together with the elevator car 4 and moved to the upper usage position P2. The upper usage position P2 is preferably determined in such a manner that a next higher travel region 2*u*+ can be serviced in the building. The section 51.1, 51.1' of the supporting element 51, 51' substantially unloaded by tensile stressing above the strand jack 53, 53' is relatively short since the vertical distance between the machine platform 20 and the strand jack 53, 53' is configured to be relatively large as a result of the arrangement of the machine platform 20 in the lower temporary usage position P1.

Before the machine platform 20 is moved into an upper usage position P2 arranged above the lower temperature usage position P1, the elevator car 4 can be suspended on the machine platform 20 by means of suspension means 45 depicted by means of dashed lines, for example by means of supporting rods, and for example can be decoupled from the drive unit 8.

FIG. 2 shows the elevator system 1 from FIG. 1 after raising the movable machine platform 20 to the upper usage position P2. As soon as this upper usage position P2 is reached, the settling device of the machine platform 20 is extended and the machine platform 20 is set down on the settling device and fixed by this in the elevator shaft 2. After a re-coupling of the drive unit 8 to the elevator car 4 has been completed, the suspension means 45 by means of which the elevator car 4 has been suspended on the machine platform 20 can be removed. The elevator system is thus available within a short time for the extended travel region 2*u*+.

The section of the supporting element 51, 51' of the at least one lifting device 50, 50' loaded by tensile stressing between the anchor 52, 52' and the strand jack 53, 53' is severely shortened in contrast to FIG. 1. Accordingly, the section 51.1, 51.1' of the supporting element 51, 51' substantially unloaded by tensile stressing above the strand jack 53, 53' is lengthened due to the completed raising of the machine platform 20. This at least one unloaded section 51.1, 51.1' is mounted above the lifting platform 30 in the selected exemplary embodiment. Since the supporting element 51, 51' should be dimensioned according to the load of the machine platform 20 plus the components of the elevator system 1 fixed on the machine platform 20, the supporting element 51, 51', which is optionally configured as steel cable or similar, has a bearing height H. This bearing height H corresponds to a vertical minimum distance between the lifting platform 30 and a temporary shaft ceiling of the elevator system 1 to be optionally arranged above the lifting platform 30.

Figure 3:
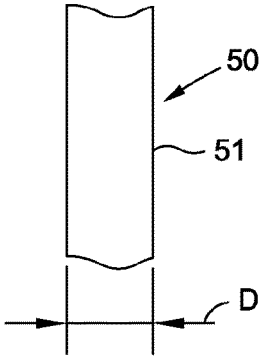
FIG. 3: shows a supporting element of a lifting device.

FIG. 3 shows a supporting element 51 of a lifting device 50. The supporting element 51 is preferably configured as steel cable, i.e. a twisting of individual wires, or as strand, i.e. a twisting of individual wires. The steel cable substantially has a circular cross-section, wherein the diameter D of the supporting element 51 is 10 mm to 30 mm, preferably 15 mm to 20 mm. When the unloaded supporting element section is optionally mounted above the lifting platform 30 shown in FIG. 2, the bearing height H shown there can certainly be more than one or two meters.

Figure 4:
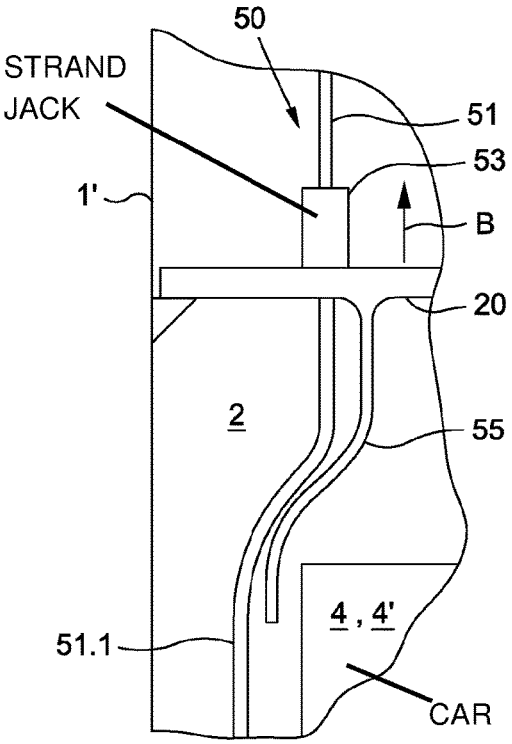
FIG. 4: shows a section of an elevator system according to a second embodiment.
Figure 5:
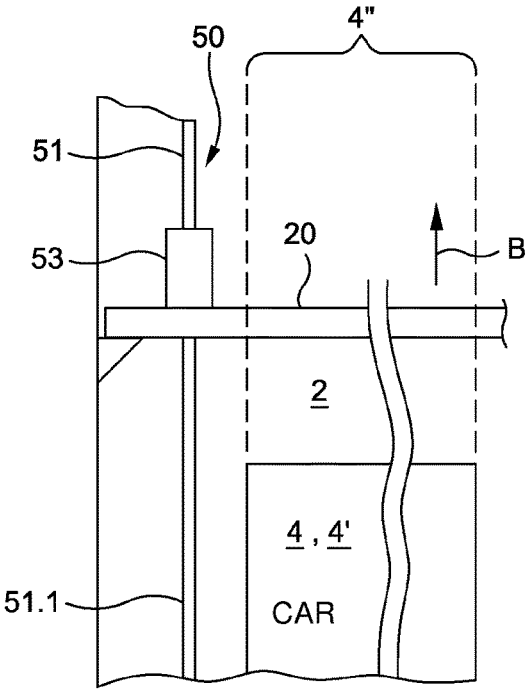
FIG. 5: shows a section of an elevator system according to a third embodiment.

FIGS. 4 and 5 show a section of alternative elevator systems 1 according to further alternative embodiments. The elevator system 1 comprises an elevator shaft 2, an elevator car 4 which can be moved in the elevator shaft 2 and a lifting device 50. Both lifting devices 50 shown in FIGS. 4 and 5 comprise a strand jack 53 fixed on a machine platform 20 and a supporting element 51. The supporting element 51 is fixed in the elevator shaft 2 by means of an anchor of the lifting device 50 not shown. During a lifting movement B to be performed by means of this lifting device 50, the strand jack 53 or the machine platform 20 fixed on the strand jack 53 is moved along the supporting element 51. Accordingly, the section 51.1 of the supporting element 51, substantially unloaded by tensile stressing underneath the machine platform 20 becomes longer. The elevator car 4 of the elevator system 1 is shown in its uppermost possible position 4' with regard to the arrangement of the machine platform 20 inside the elevator shaft 2. A shaft interior space of the elevator shaft 2 is delimited by a side wall 1' of the elevator shaft 2.

The machine platform 20 of the elevator system 1 shown in FIG. 4 has a deflector 55. This deflector 55 is largely arranged underneath the strand jack 53. The deflector 55 of the machine platform 20 is used to deflect the section 51.1 substantially unloaded by tensile stressing so that this section 51.1 of the supporting element 51 does not project into the travel path of the elevator car 4. Accordingly, the supporting element 51, in particular the section 51.1 of the supporting element 51 arranged underneath the machine platform 20 cannot collide with the elevator car 4 which can be located, for example, in its uppermost position 4'.

The strand jack 53 shown in FIG. 5 is fixed to the machine platform 20 in such a manner that the section 51.1 of the supporting element 51 arranged underneath the strand jack is arranged outside a vertical projection 4" of the elevator car 4. Accordingly, no component of the section 51.1 of the supporting element arranged underneath the machine platform 20 is arranged vertically above the elevator car 4 preferably arranged in its uppermost possible position 4'.

Figure 6:
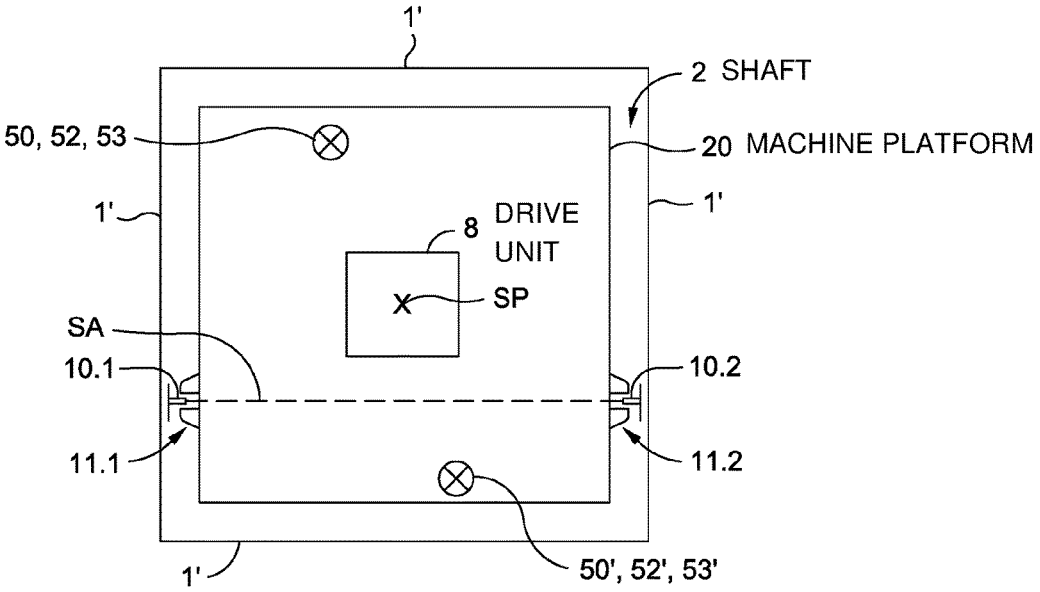
FIG. 6: shows a horizontal cross-section of an elevator shaft with a machine platform fixed in the elevator shaft.
Figure 7:
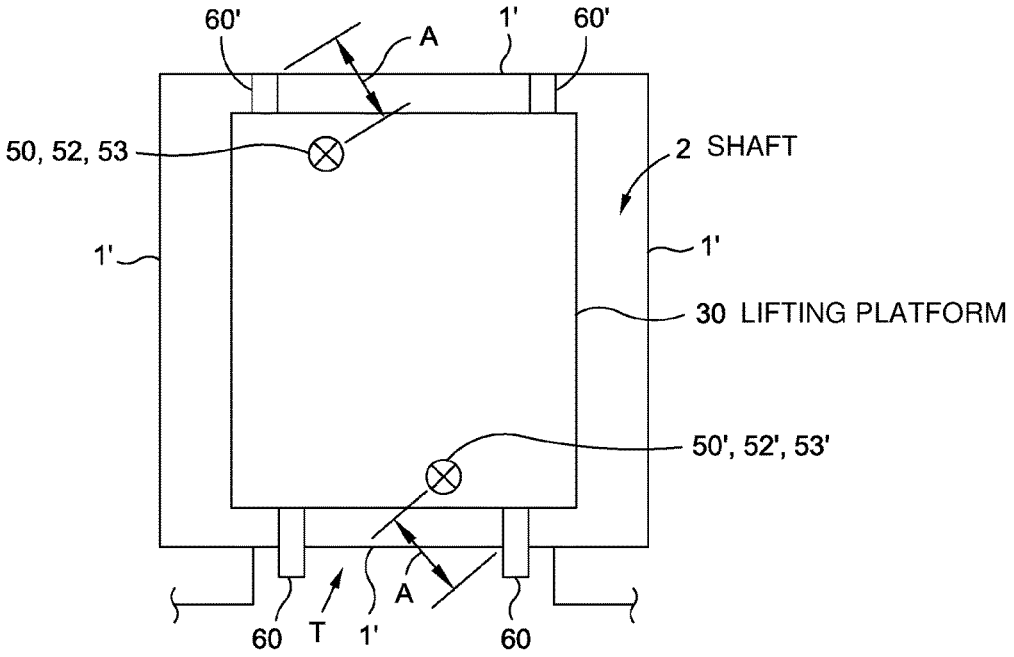
FIG. 7: shows another horizontal cross-section of the elevator shaft shown in FIG. 6 with a lifting platform fixed in the elevator shaft.

FIGS. 6 and 7 show horizontal cross-sections of an elevator shaft 2. A shaft interior of the elevator shaft 2 is delimited by usually vertical side walls 1'. Guide rails 10.1, 10.2 are installed on two side walls 1' opposite to these, wherein these guide walls 10.1, 10.2 are only shown in FIG. 6. The guide rails 10.1, 10.2 enable a guidance of the elevator car not shown along its travel path.

FIG. 6 shows a machine platform 20 fixed or installed in the elevator shaft 2. For example, guide shoes 11.1, 11.2 can be fixed on the machine platform 20. These guide shoes 11.1, 11.2 are located in engagement with the guide rails 10.1, 10.2 in order to enable a guidance of the machine platform 20 when the machine platform 20 has been raised to a changed usage position inside the elevator shaft 2. A rectilinear connection of these two guide rails 10.1, 10.2 is usually designated as rail axis SA.

A strand jack 53 or an anchor 52 of a first lifting device 50, a strand jack 53' or an anchor 52' of a second lifting device 50' and a drive unit 8 for moving the elevator car are fixed on the machine platform 20. The arrangement of the drive unit 8 on the machine platform 20 can have the effect that the center of gravity SP of the machine platform 20 is spaced apart from the rail axis SA. Alternatively to this, a strand jack 53 or at least one anchor 52 of only one lifting device 50 can be arranged in the immediate vicinity of the center of gravity SP. The components 52, 53, 52', 53' fixed on the machine platform 20 or the component 52, 53 fixed on the machine platform 20 of the first or second lifting device 50, 50' is/are fixed on the machine platform 20 in such a manner that the machine platform is substantially balanced out.

FIG. 7 shows a lifting platform 30 fixed in the elevator shaft 2, which can be part of the elevator system shown in FIG. 6. The lifting platform 30 is arranged at the height of a door opening T in the elevator shaft 2. Depending on which of the components 52, 53, 52', 53' of the respective lifting device 50, 50' to be fixed in the elevator shaft 2 is or are fixed on the machine platform 20 shown in FIG. 6, the other of these components to be fixed in the elevator shaft 2 is fixed on the lifting platform 30. If the strand jack 53 of the first lifting device 50 is fixed on the machine platform 20, the anchor 52 of the first lifting device 50 is fixed on the lifting platform 30 and vice versa. If the strand jack 53' of the second lifting device 50' is fixed on the machine platform 20, the anchor 52' of the second lifting device 50' is fixed on the lifting platform 30 and vice versa. Preferably the strand jacks 53, 53' of the two lifting devices 50, 50' are fixed on the machine platform 20 or the lifting platform 30, when the elevator system shown in FIGS. 6 and 7 comprises two lifting devices 50, 50'. The positioning of the strand jack(s) 53. 53' or anchor(s) 52, 52' fixed on the lifting platform 30 is dependent on the components of the corresponding lifting device 50, 50' fixed on the machine platform 20. Preferably the supporting element of the corresponding lifting device(s) 50, 50' runs vertically between the lifting platform 30 and the machine platform 20. That is that the strand jacks 53, 53' and the anchor 52, 52' of one of the lifting devices 50, 50' are arranged vertically above one another.

The lifting platform 30 can be supported or fixed by means of at least one platform supporting element 60, 60' on the side walls 1' of the elevator shaft 2. Accordingly, the lifting platform 30 can also be supported at the floor in the region of the door opening T. Such supporting elements 60, 60' can for example be formed from extendable rests or supports and be guided longitudinally displaceably in a hollow profile of the lifting platform 30. In a front region, that is in a region of the door opening T, these supporting elements 60 can be pulled so that they overlap with a floor, i.e. the sill of the door opening T. In the rear region of the lifting platform 30 these supporting elements 60' can be pushed from front to back by means of control rods so that they project into niches or recesses of the rear side wall 1'. The supporting elements 60, 60' can thus be actuated without stepping on the lifting platform 30. Naturally lateral niches, recesses, wall projections or supporting brackets can also be used, wherein the corresponding supporting elements not shown in FIG. 7 would then be extended or pivoted out laterally.

The supporting element of the lifting device 50, 50' fixed by means of the strand jack 53, 53' or by means of the anchor 52, 52' on the lifting platform 30 has a horizontal distance A from the fixing point of a supporting element 60 on the side wall 1'. This horizontal distance A can be determined by means of that supporting element 60 which is located in the closest proximity to the anchor 52, 52' being considered or to the strand jack 53, 53' being considered. Preferably this horizontal distance A is a maximum of 700 mm. In an advantageous embodiment this horizontal distance A is a maximum of 500 mm.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system including an elevator car movable in an elevator shaft and a drive unit for moving the elevator car, comprising:

a machine platform arranged in the elevator shaft for lifting along the elevator shaft, wherein the drive unit is fixed on the machine platform and has at least one lifting device for lifting the machine platform;

wherein the at least one lifting device includes a lifting supporting element, a strand jack and an anchor, the lifting supporting element being fixed in the elevator shaft by the anchor and the strand jack arranged to move along the lifting supporting element, wherein the strand jack is fixed on the machine platform; and wherein a section of the lifting supporting element is arranged underneath the strand jack, the section being outside a vertical projection of the elevator car or the machine platform having a deflector for guiding the section outside a travel path of the elevator car.

2. The elevator system according to claim 1 including two of the lifting device for lifting the machine platform.

3. The elevator system according to claim 1 including a lifting platform arranged in the elevator shaft above the machine platform for lifting the machine platform, wherein the strand jack or the anchor is fixed on the lifting platform.

4. The elevator system according to claim 3 wherein the lifting platform is fixed by at least one platform supporting element on a side wall of the elevator shaft, wherein the lifting supporting element is spaced from a fixing point of the platform supporting element on the side wall by a horizontal distance of not more than 700 mm.

5. The elevator system according to claim 1 wherein the strand jack is based on a hydraulic functional principle.

6. The elevator system according to claim 1 including two guide rails fixed in the elevator shaft for guiding the elevator car and for guiding the machine platform, wherein the drive unit is fixed to the machine platform so that a center of gravity of the drive unit acting on the machine platform is spaced from a rail axis, the rail axis being a shortest possible rectilinear connection between the two guide rails, and wherein at least one of the strand jack and the anchor is spaced apart from the rail axis on the machine platform to balance out the machine platform.

7. The elevator system according to claim 1 wherein the lifting supporting element has a circular cross-section.

8. The elevator system according to claim 7 wherein the circular cross-section has a diameter in a range of 10 mm to 30 mm.

9. The elevator system according to claim 1 wherein the lifting supporting element is a wire cable.

* * * * *